US012064025B2

(12) United States Patent
Bonn

(10) Patent No.: US 12,064,025 B2
(45) Date of Patent: Aug. 20, 2024

(54) CHEST-WORN TACTICAL GEAR SUPPORT ASSEMBLY

(71) Applicant: Javlin Concepts, LLC, Folsom, CA (US)

(72) Inventor: Boston Isaac Bonn, Folsom, CA (US)

( * ) Notice: Subject to any disclaimer, the term of this patent is extended or adjusted under 35 U.S.C. 154(b) by 0 days.

(21) Appl. No.: 17/396,607

(22) Filed: Aug. 6, 2021

(65) Prior Publication Data

US 2022/0039543 A1 Feb. 10, 2022

Related U.S. Application Data

(60) Provisional application No. 63/062,309, filed on Aug. 6, 2020.

(51) Int. Cl.
*A45F 3/14* (2006.01)
*A45F 3/00* (2006.01)

(52) U.S. Cl.
CPC ..... *A45F 3/14* (2013.01); *A45F 2003/003* (2013.01); *A45F 2003/144* (2013.01)

(58) Field of Classification Search
CPC . A45F 3/14; A45F 2003/003; A34F 2003/144
See application file for complete search history.

(56) References Cited

U.S. PATENT DOCUMENTS 5,147,261 A * 9/1992 Smith ..... A61F 5/028 482/106
5,464,136 A * 11/1995 Eddy ..... F41C 33/046 2/322
5,656,020 A * 8/1997 Greengarg ..... A61F 5/026 2/48
7,047,570 B2 * 5/2006 Johnson ..... F41H 1/02 2/102
7,987,523 B2 * 8/2011 Cole ..... F41H 1/02 2/102
8,365,312 B2 * 2/2013 Herring ..... A41D 13/0007 2/2.5
8,418,265 B1 * 4/2013 Storms, Jr. ..... F41H 1/02 2/2.5
8,490,212 B1 * 7/2013 Asher ..... A41D 1/04 2/2.5
8,572,762 B2 * 11/2013 Herbener ..... F41H 1/02 2/2.5

(Continued)

*Primary Examiner* — Nathan J Newhouse
*Assistant Examiner* — Lester L Vanterpool

(57) ABSTRACT

A chest-worn, tactical gear support (CWTGS) assembly includes a cummerbund having an elongate band wrappable around a torso of a wearer with first and second end portions that adjustably engage to fit a girth of the wearer. In one version, a modular gear attachment belt of the CWTGS assembly has equipment receiving features on an outward surface and is releasably engaged on the cummerbund to form a chest rig. The modular gear attachment belt is expeditiously replaceable to reconfigure or replenish gears and stores of the CWTGS assembly. Alternatively or in addition, a tactical vest of the CWTGS assembly includes a front panel and a back panel connected by right and left shoulder straps. A rearward positioned portion of the cummerbund passes through a horizontal back sleeve of the tactical vest. An inner engagement surface of the cummerbund is releasably engaged to a front engagement surface of the tactical vest.

19 Claims, 16 Drawing Sheets

(56) References Cited

U.S. PATENT DOCUMENTS

| | | | | |
|---|---|---|---|---|
| 8,595,862 | B2 * | 12/2013 | Storms, Jr. | A41D 13/05 2/2.5 |
| 9,241,547 | B2 * | 1/2016 | Raymond | A41D 1/06 |
| 9,339,102 | B2 * | 5/2016 | Iosilevich | A45F 3/14 |
| D767,824 | S * | 9/2016 | Hilliard | D29/100 |
| 9,562,746 | B2 * | 2/2017 | Khandelwal | F41H 1/02 |
| 9,801,458 | B2 * | 10/2017 | Storms, Jr. | F41H 1/02 |
| 9,901,127 | B2 * | 2/2018 | LeMarbe | A41D 13/0556 |
| 9,943,125 | B2 * | 4/2018 | LeMarbe | F41H 1/02 |
| 10,264,874 | B2 * | 4/2019 | Becker | A45F 3/14 |
| D850,101 | S * | 6/2019 | Mironski | D3/224 |
| 11,079,203 | B2 * | 8/2021 | Becker | A41D 13/0012 |
| 11,517,061 | B2 * | 12/2022 | May | A45F 5/02 |
| 2005/0005343 | A1 * | 1/2005 | Johnson | F41H 1/02 2/102 |
| 2011/0094006 | A1 * | 4/2011 | Cole | F41H 1/02 2/102 |
| 2011/0231976 | A1 * | 9/2011 | Herbener | F41H 1/02 2/2.5 |
| 2014/0201879 | A1 * | 7/2014 | Seuk | F41H 1/02 2/2.5 |
| 2014/0259300 | A1 * | 9/2014 | Iosilevich | A45F 3/14 2/300 |
| 2014/0346821 | A1 * | 11/2014 | Flis | A45F 5/00 224/665 |
| 2019/0041167 | A1 * | 2/2019 | Swan | F41H 5/013 |
| 2019/0075916 | A1 * | 3/2019 | Becker | A45F 5/02 |
| 2019/0166926 | A1 * | 6/2019 | Doroski | A41D 13/0007 |
| 2020/0059196 | A1 * | 2/2020 | Thiel | H01M 50/256 |
| 2020/0300582 | A1 * | 9/2020 | Becker | A41D 13/0012 |

* cited by examiner

CHEST-WORN TACTICAL GEAR SUPPORT ASSEMBLY

TECHNICAL FIELD

The present disclosure relates generally to wearable, load-carrying tactical gear, and more particularly, to load-carrying tactical gear that is chest worn.

BACKGROUND

Certain jobs require that a person wear tactical gear that is used in time-critical situations. Examples of such jobs include infantry soldiers and marines, police, fire fighters, and medical first responders. Ideally, the worn tactical gear does not prevent, or excessively encumber, movement on foot or in and out of vehicles. The worn tactical gear needs to be adjustable to accommodate a wide range of body sizes and combinations of worn garments and equipment, properly distributing the weight for comfort. Often the tactical gear is added individually to meet specific mission requirements. Examples of chest worn tactical gear include tactical vests and chest rigs that can be worn individually or in combination. Tactical vests often incorporate shielding material and plates for ballistic protection as well as having pockets and attachment features for tactical gear and stores. Chest rigs support gear and stores that are attached on at least one of an equipment belt and suspenders.

Generally, known chest worn equipment for carrying tactical gear does enable a wearer to have access to a widely configurable array of offensive and defensive gear and stores. In many instances, sufficient adjustment is provided by the equipment to properly position a selected combination of garments and gear. With changing mission requirements and use of stores, the wearer can replace tactical gear on the equipment and return to performance of tasks. However, the time required to adjust the equipment before or after donning can be considerable. In addition, coming out of the fight to replace gear and stores can seriously degrade performance of the mission. Carrying extra gear and stores to handle a longer duration mission, or for being ready for different missions, imposes a carry weight penalty that may be unacceptable.

SUMMARY

In one aspect of the present disclosure, a chest-worn, tactical gear support (CWTGS) assembly includes a cummerbund and a modular gear attachment belt. The cummerbund includes an elongate band that is wrappable around a torso of a wearer. The elongate band has an outer engagement surface and terminates at first and second end portions that adjustably engage to fit a girth of the wearer. The modular gear attachment belt includes equipment receiving features on an outward surface. The modular gear attachment belt includes an inward engagement surface that releasably engages the outer engagement surface of the cummerbund to form a chest rig.

In another aspect of the present disclosure, a CWTGS assembly includes a tactical vest and a cummerbund. The tactical vest includes a front panel and a back panel connected by right and left shoulder straps. The front panel has a front engagement surface. The back panel has a horizontal back sleeve. The cummerbund includes an elongate band wrappable around a torso of a wearer of the tactical vest. The elongate band has an inner engagement surface and terminates at first and second end portions that adjustably engage to fit a girth of the wearer. A rearward positioned portion of the cummerbund passes through the horizontal back sleeve of the tactical vest. The inner engagement surface releasably engages the front engagement surface of the tactical vest.

In an additional aspect of the present disclosure, a method is provided for expedited replenishment and reconfiguration of chest-worn gear and stores. In one or more embodiments, the method includes wrapping an elongate band of a cummerbund around a torso of a wearer. The method includes engaging terminating first and second end portions of the elongate band that adjustably engages to fit a girth of the wearer. The method includes releasably engaging an inward engaging surface of a first modular gear attachment belt to an outer engagement surface of the cummerbund to form a CWTGS assembly. The first modular gear attachment belt has equipment receiving features on an outward surface that are provisioned with a first set of gear and stores. The method includes subsequently replacing the first modular gear attachment belt on the cummerbund with a second modular gear attachment belt that is provisioned with a second set of gear and stores for one or more of: (i) expedited replenishment of the first set of gear that is expended; and (ii) reconfiguration of the CWTGS assembly for different tactical mission requirements.

These and other features are explained more fully in the embodiments illustrated below. It should be understood that in general the features of one embodiment also may be used in combination with features of another embodiment and that the embodiments are not intended to limit the scope of the disclosure.

BRIEF DESCRIPTION OF THE DRAWINGS

The various exemplary embodiments of the present disclosure, which will become more apparent as the description proceeds, are described in the following detailed description in conjunction with the accompanying drawings, in which.

DETAILED DESCRIPTION

A chest-worn, tactical gear support (CWTGS) assembly includes a cummerbund having an elongate band wrappable around a torso of a wearer with first and second end portions that adjustably engage to fit a girth of the wearer. In one version, a modular gear attachment belt of the CWTGS assembly has equipment receiving features on an outward surface and is releasably engaged on the cummerbund to form a chest rig. The modular gear attachment belt is expeditiously replaceable to reconfigure or replenish gears and stores of the CWTGS assembly. Alternatively or in addition, a tactical vest of the CWTGS assembly includes a front panel and a back panel connected by right and left shoulder straps. A rearward positioned portion of the cummerbund passes through a horizontal back sleeve of the tactical vest. An inner engagement surface of the cummerbund is releasably engaged to a front engagement surface of the tactical vest.

Figure 1:
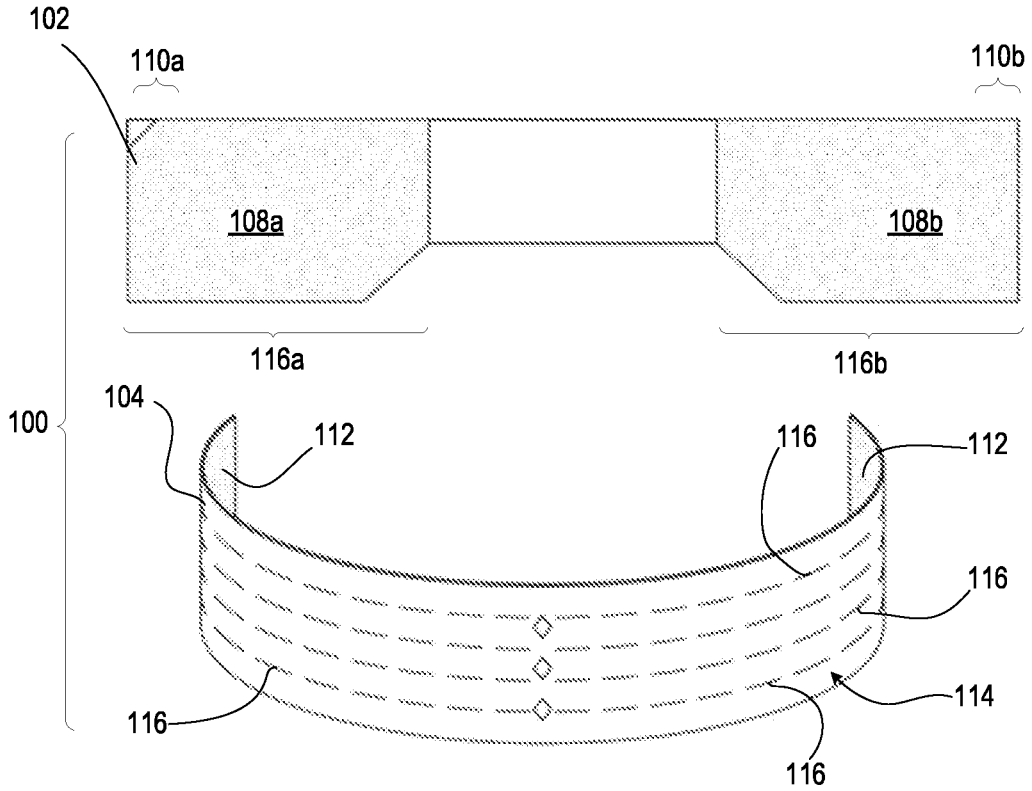
FIG. 1 depicts a front view of a cummerbund and a modular gear attachment belt of an example chest-worn tactical gear support (CWTGS) assembly, according to one or more embodiments.

FIG. 1 depicts example chest-worn tactical gear support (CWTGS) assembly 100 that includes cummerbund 102 and modular gear attachment belt 104. Cummerbund 102 includes an elongate band that includes an elastic central portion 120, and right and left sections 118 *a*-118 *b*, which extend about the torso of a wearer such that the right or left inner engagement surfaces 108 *a*-108 *b* of corresponding right or left sections 118 *a*-118 *b*, overlapping an outer engagement surface 207 (FIG. 2A) of the opposing right or left sections 118 *a*-118 *b* to securely close cummerbund 102 about the torso of the wearer. Terminating right and left end portions 110 *a*-110 *b* of right and/or left inner engagement surfaces 108 *a*-108 *b* may include a portion that does not engage opposing attachment surfaces, allowing the wearer to quickly and easily disengage the right or left inner engagement surface 108 *a*-108 *b* from outer engagement surface 207 in order to doff cummerbund 102. Modular gear attachment belt 104 has an inward engagement surface 112 and equipment receiving features 116 on outward surface 114. In one or more embodiments, equipment receiving features are a grid array of horizontal slits 116. A height and length of modular gear attachment belt 104 corresponds to the height of right and left sections 118 *a*-118 *b* of cummerbund 102, which are positioned to receive modular gear attachment belt 104. In one or more embodiments, central portion 120 of cummerbund 102, which connects right and left sections 118 *a*-118 *b* of cummerbund 102, may have a reduced height, which can enable placement of a constricting portion of cummerbund 102 against the back and below the diaphragm of a wearer. The increased height of right and left sections 118 *a*-118 *b* of cummerbund 102 and corresponding height of equipment receiving features on outward surface 114 of modular gear attachment belt 104 provides a greater area of the chest rig for receiving tactical equipment and stores.

Figure 2A:
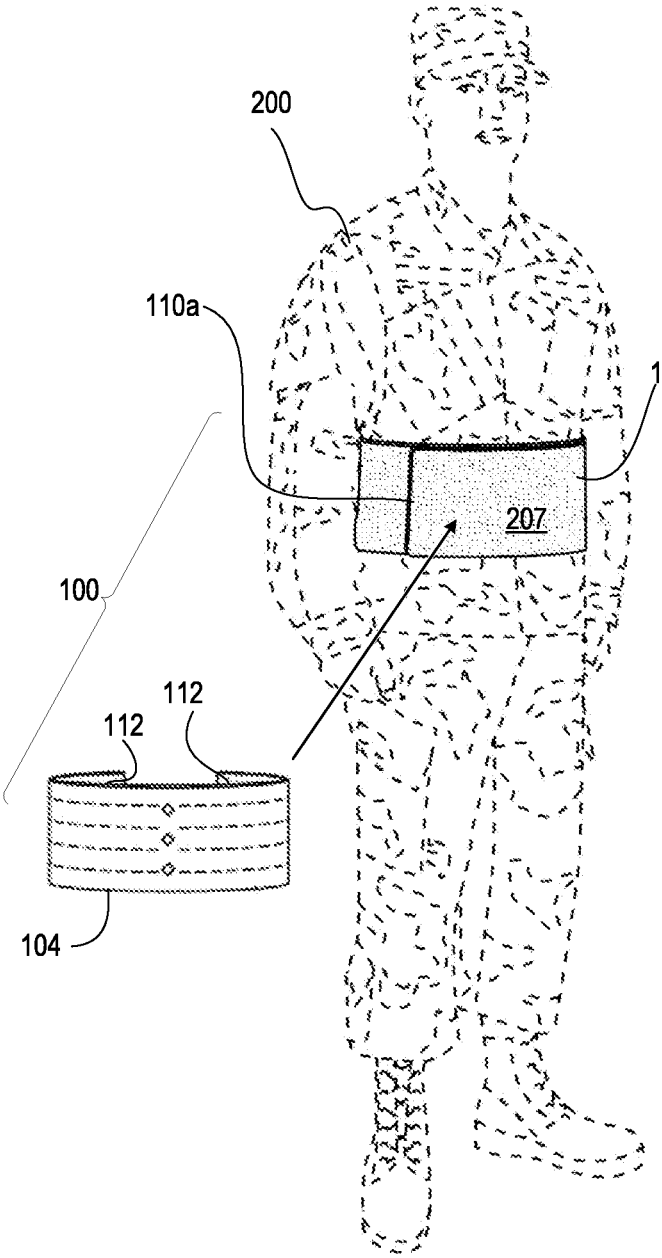
FIG. 2A depicts a front view of the cummerbund of the CWTGS assembly of FIG. 1 placed on a torso of a wearer, according to one or more embodiments.
Figure 2B:
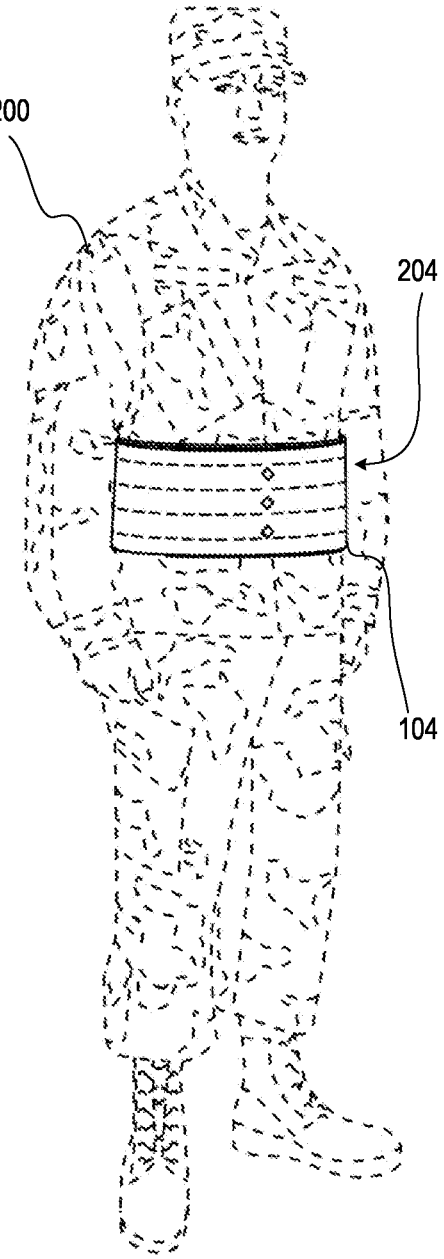
FIG. 2B depicts a front view of the modular gear attachment belt of the CWTGS assembly placed on the torso of the wearer of FIG. 2A, according to one or more embodiments.

FIG. 2A depicts a front view of the cummerbund of the CWTGS assembly 100 placed on a torso of wearer 200. Cummerbund 102 has outer engagement surface 207 that can releasably engage inward engagement surface 112 of modular gear attachment belt 104. First end portion 110*a* and second end portion 110*b* (FIG. 1) can adjustably engage to fit a girth of the wearer 200, such as by overlapping to a lesser or greater extent. To expedite adjustment and donning, engagement between outer engagement surface 207 of cummerbund 102 and inward engagement surface 112 of modular gear attachment belt 104 can include one or more of: (i) hook and loop material fastening; (ii) magnetic attraction fastening; and (iii) male and female mechanical fastening (e.g., snaps, hook and eye fasteners, etc.). FIG. 2B depicts modular gear attachment belt 104 placed overtop of, and engaging, cummerbund 102 (FIG. 2A) to form chest rig 204 that transfers weight to the torso of wearer 200. Other equipment such as a backpack can transfer weight to shoulders and hips of wearer 200.

Surfaces/panels described herein have a capability to releasably engage. In one or more embodiments, the engagement is repeatable for a service life of the equipment. The engagement can be one material or structure that is attracted to or adheres to the same material or structure. The engagement can be complementary with different materials and structures. The engagement provides appropriate sheer strength to maintain a bond in light of forces to which they are exposed during use. In one or more embodiments, the engagement is based on mechanical, chemical touch, or pressure-activated surfaces designed to mate or bond with an opposing fastener surface. One example of a releasably engaging surface is hook-and-loop fastener surfaces (commonly referred to as VELCRO).

Figure 3A:
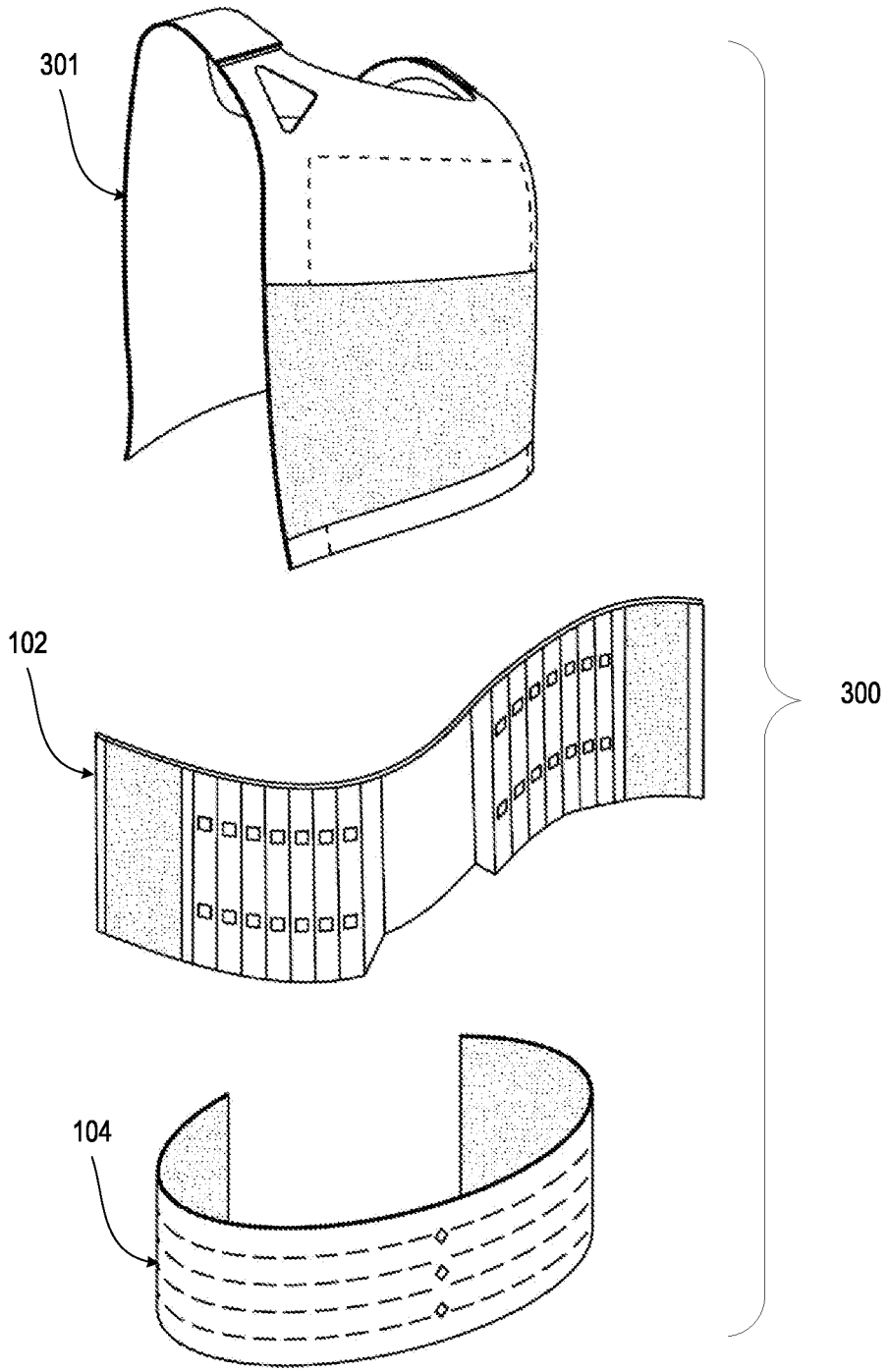
FIG. 3A depicts a 3D disassembled front right view of an example CWTGS assembly that includes a tactical vest, a cummerbund, and a modular gear attachment belt, according to one or more embodiments.
Figure 3B:
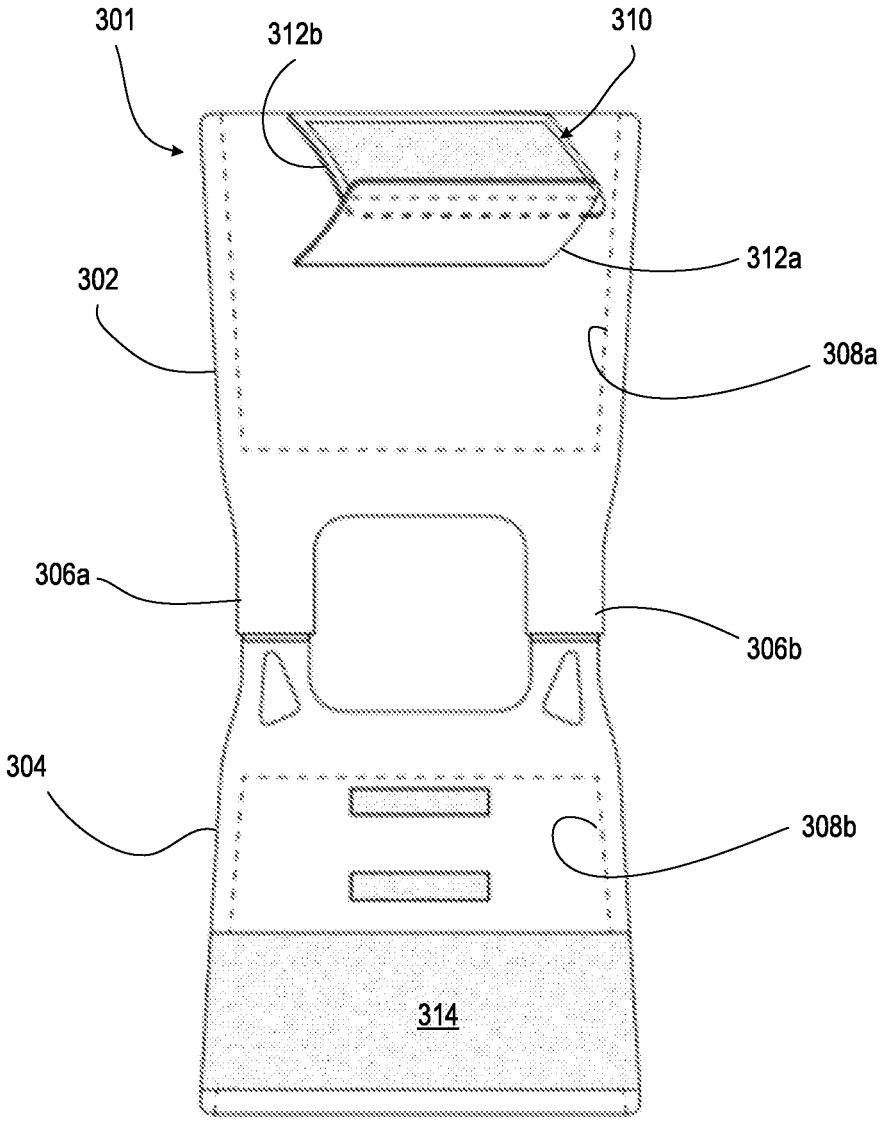
FIG. 3B depicts a top view of a tactical vest of FIG. 3A that is unfolded, according to one or more embodiments.

FIG. 3A depicts a 3D disassembled front right view of an example CWTGS assembly 300 that includes tactical vest 301 and cummerbund 102. In one or more embodiments, CWTGS assembly 300 further includes modular gear attachment belt 104. FIG. 3B depicts a top view of tactical vest 301 having a back panel 302 and front panel 304 that are connected by right and left shoulder straps 306*a*-306*b*. In one or more embodiments, tactical vest 301 includes back and front plate carrier enclosures 308*a*-308*b*. A feature for engaging with cummerbund 102 (FIG. 3A) is provided by horizontal rear sleeve 310 on back panel 302 that is formed by top and bottom flaps 312*a*-312*b*. Another feature for engaging with inner engagement surfaces 108*a*-108*b* of cummerbund 102 (FIG. 3B) is provided by front engagement surface 314 for engagement by one or more of: (i) hook and loop material fastening; (ii) magnetic attraction fastening; and (iii) male and female mechanical fastening.

Figure 4A:
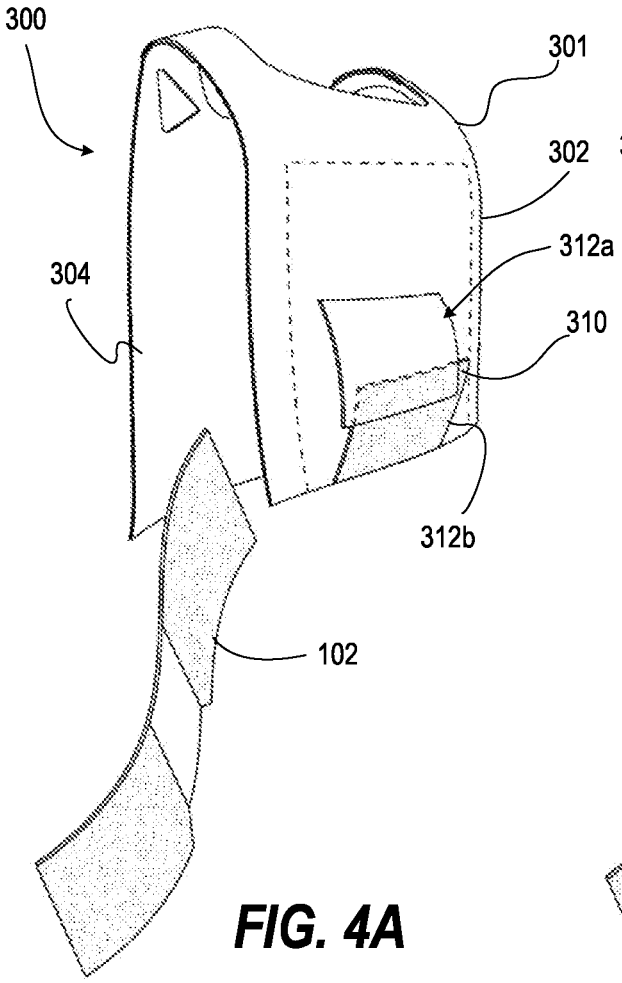
FIG. 4A depicts a back left view of the cummerbund positioned for insertion into a horizontal back sleeve of the example tactical vest of FIG. 3B, according to one or more embodiments.
Figure 4B:
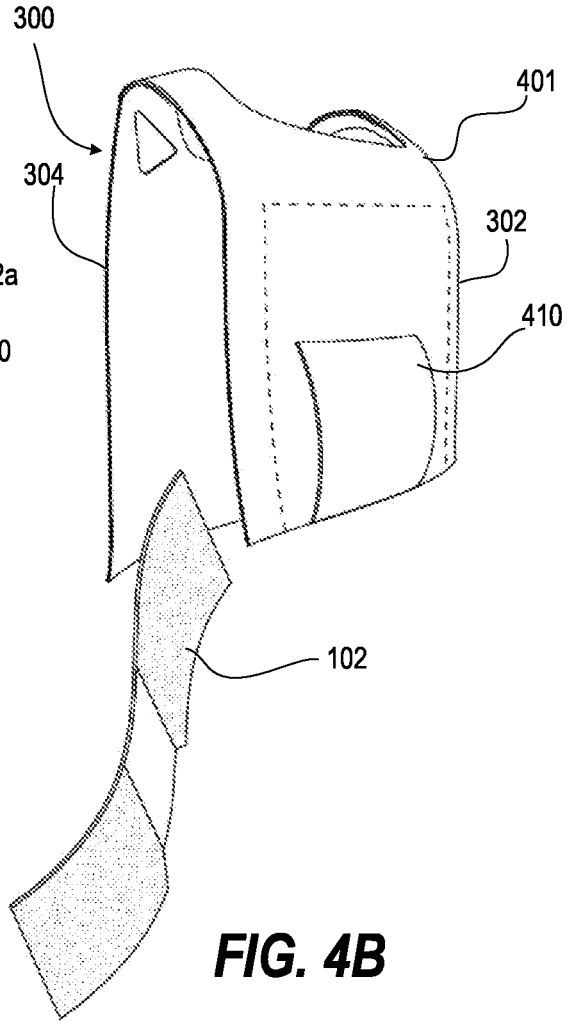
FIG. 4B depicts a back left view of the cummerbund positioned for insertion into a unitary horizontal back sleeve of an example tactical vest, according to one or more embodiments.
Figure 4C:
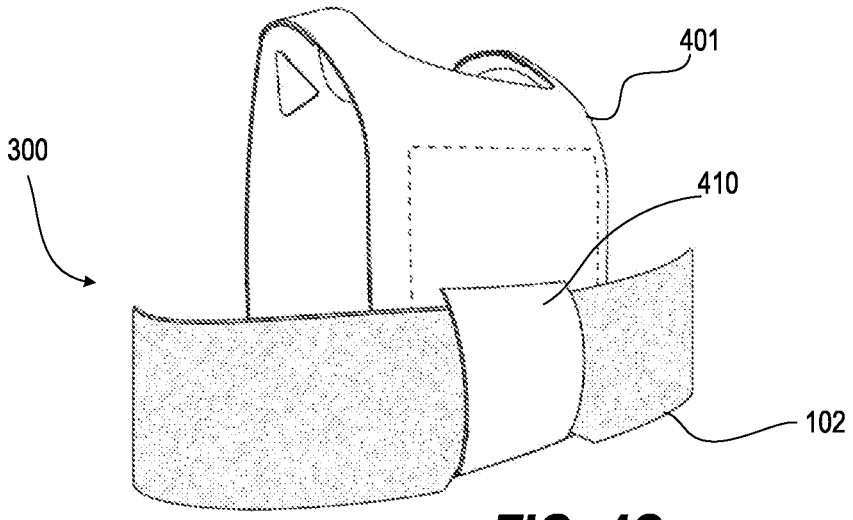
FIG. 4C depicts a back left view of the cummerbund inserted through the horizontal back sleeve of the example tactical vest of FIG. 4B, according to one or more embodiments.

FIG. 4A depicts a back left view of example CWTGS assembly 300 that includes cummerbund 102 and example tactical vest 301. Cummerbund 102 expeditiously secures back panel and front panels 302, 304 of example tactical vest 301 with adjustment for an appropriate girth size. Cummerbund 102 is positioned for insertion into engaged top and bottom flaps 312*a*-312*b* that form horizontal rear sleeve 310 of example tactical vest 301. FIG. 4B depicts a back left view of cummerbund 102 positioned for insertion into unitary horizontal back sleeve 410 of example tactical vest 401. FIG. 4C depicts a back left view of cummerbund 102 inserted through unitary horizontal back sleeve 410 of example tactical vest 401.

Figure 4D:
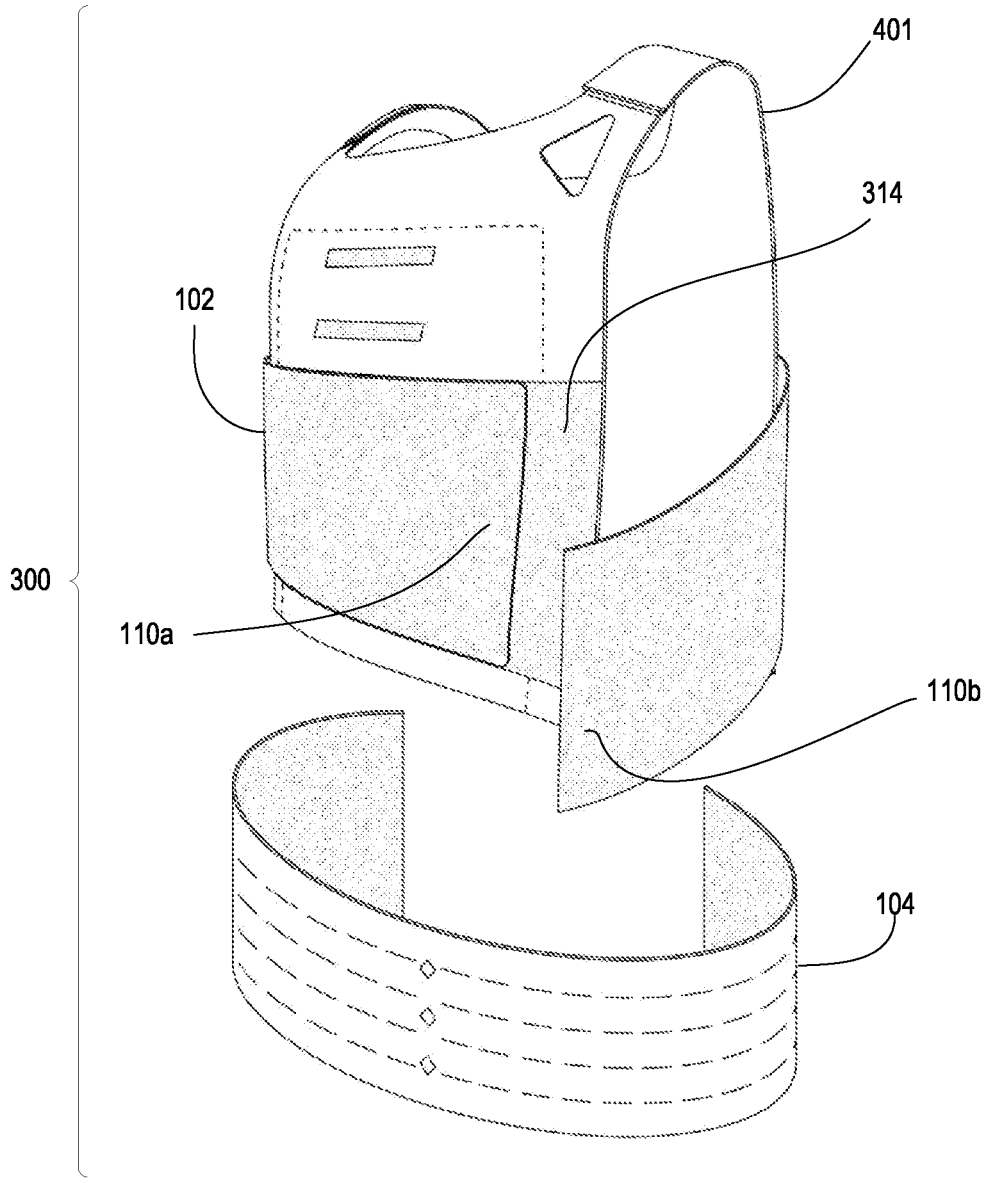
FIG. 4D depicts a front left view of the cummerbund with terminating right end portion engaged first to front panel of example tactical vest of FIG. 4B, according to one or more embodiments.
Figure 4E:
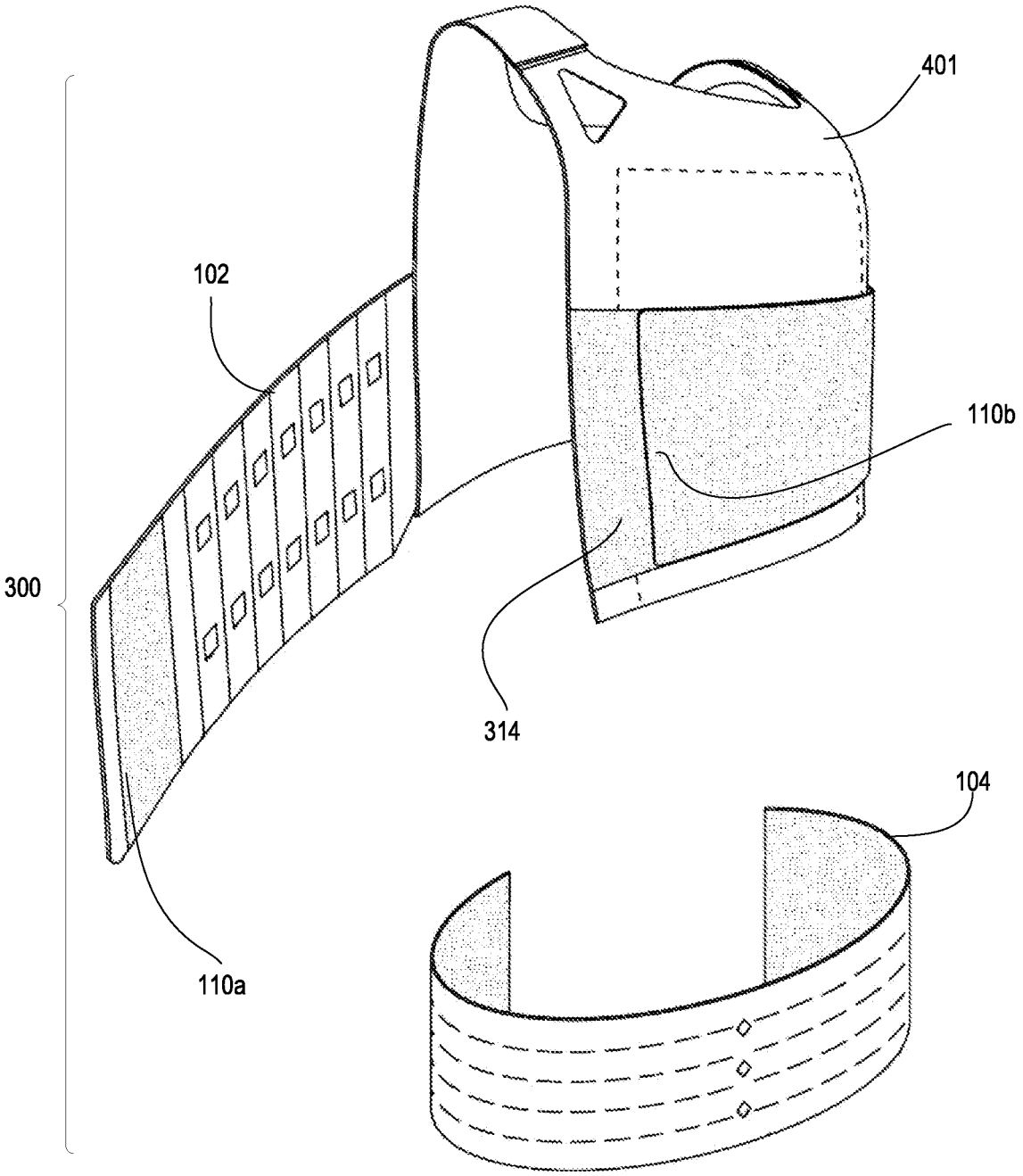
FIG. 4E depicts a front right view of the cummerbund with terminating left end portion engaged first to front panel of example tactical vest of FIG. 4B, according to one or more embodiments.
Figure 4F:
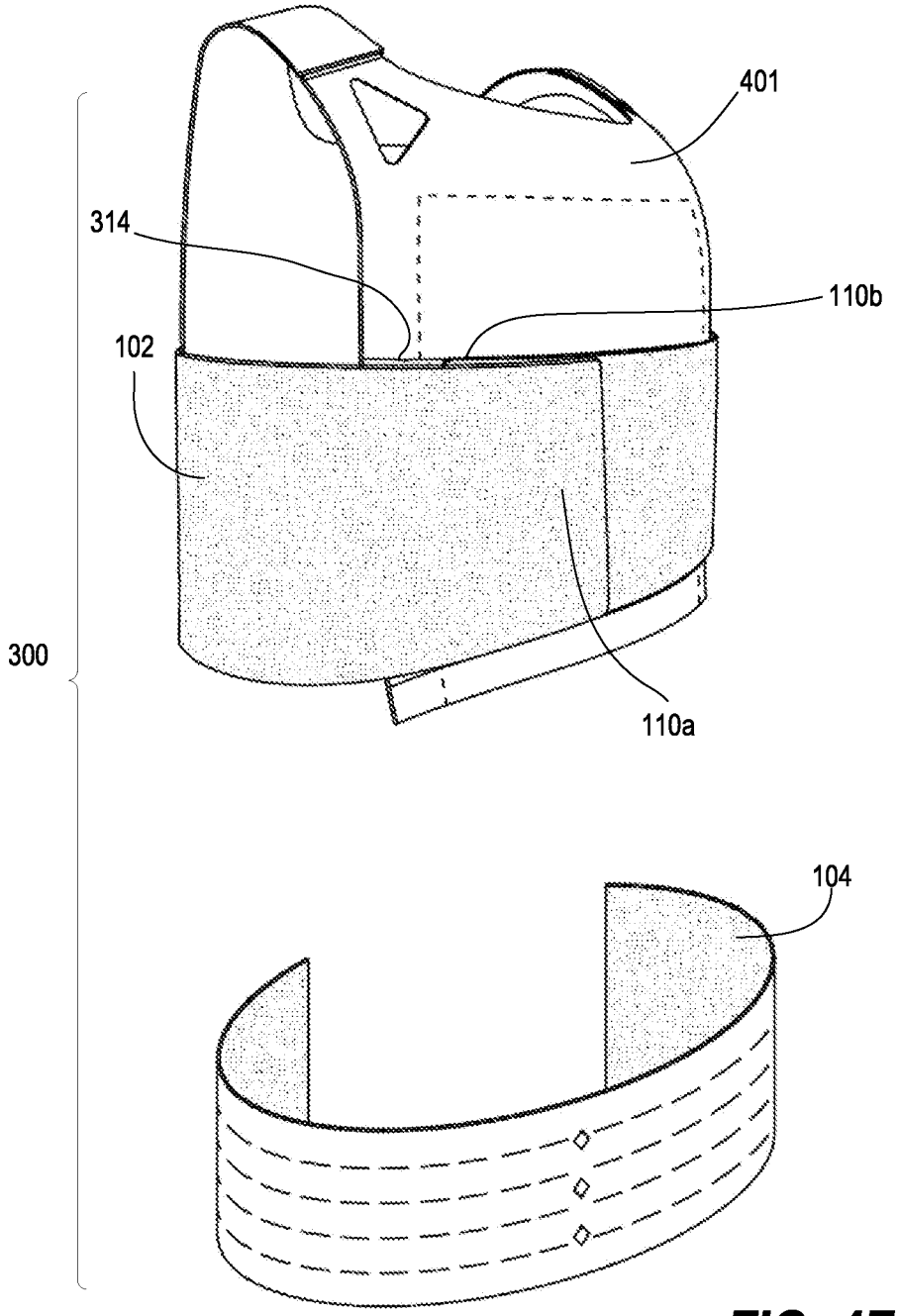
FIG. 4F depicts a front right view of the cummerbund with terminating right end portion engaged second over terminating left end portion to secure the example tactical vest of FIG. 4B, according to one or more embodiments.
Figure 4G:
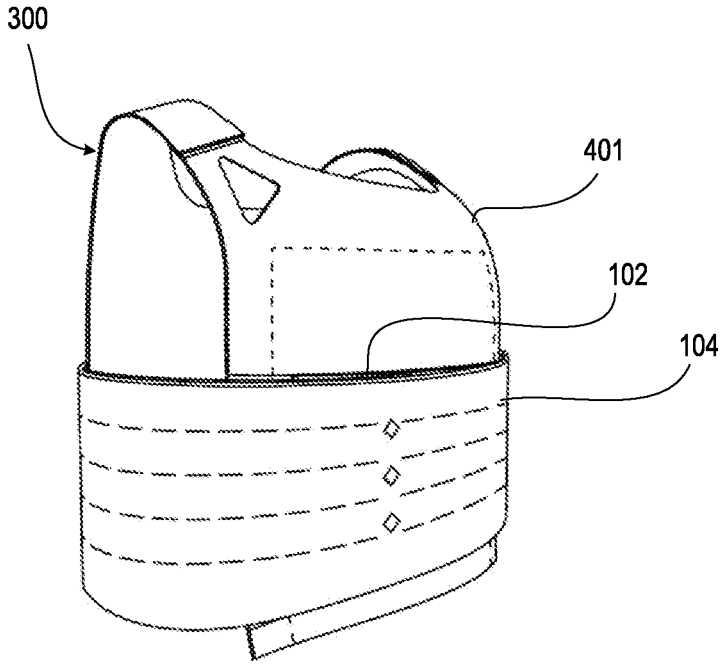
FIG. 4G depicts a front right view of the CWTGS assembly of FIG. 4F with the modular gear attachment belt engaged to the cummerbund, according to one or more embodiments.
Figure 4H:
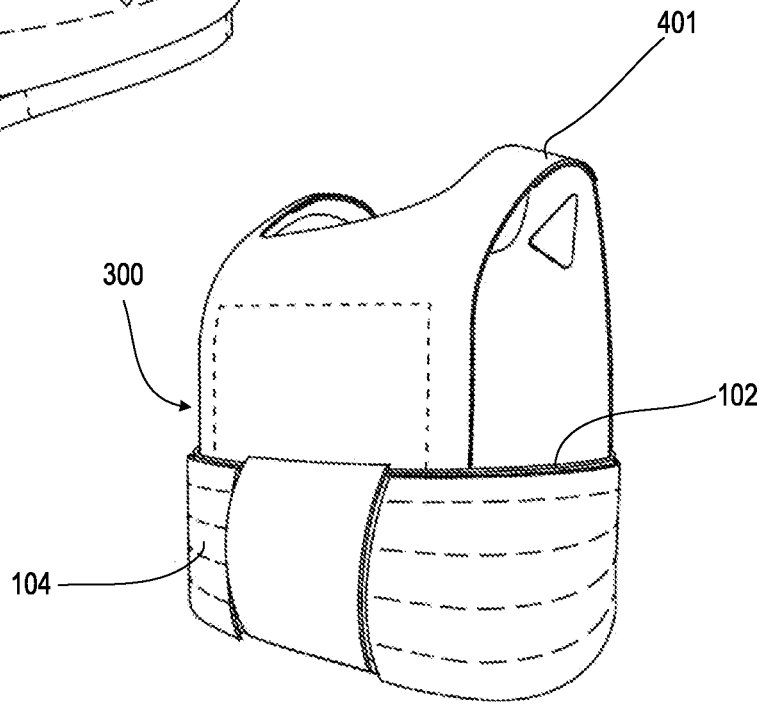
FIG. 4H depicts a rear right view of the CWTGS assembly of FIG. 4G, according to one or more embodiments.

FIG. 4D depicts a front left view of example CWTGS assembly 300 with terminating right end portion 110*a* of cummerbund 102 engaged to front engagement surface 314 of tactical vest 401. Terminating left end portion 110*b* of cummerbund 102 is thus the last portion engaged on top of terminating right end portion 110*a* and is directed toward the right lateral side. Removal of cummerbund 102 begins pulling terminating left end portion 110*b* of cummerbund 102 to the left. FIG. 4E depicts a front right view of example CWTGS assembly 300 with terminating left end portion 110*b* of cummerbund 102 engaged to front engagement surface 314 of tactical vest 401. FIG. 4F depicts a front right view of cummerbund 102 with terminating right end portion 110*a* engaged second over terminating left end portion to secure example tactical vest 301. Terminating right end portion 110*a* of cummerbund 102 is thus the last portion engaged on top of terminating left end portion 110*b* and is directed toward the left lateral side. Removal of cummerbund 102 would begin with pulling terminating right end portion 110*a* of cummerbund 102 to the right. FIG. 4G depicts a front right view of the CWTGS assembly 300 with modular gear attachment belt 104 engaged to cummerbund 102 over tactical vest 401. FIG. 4H depicts a rear right view of CWTGS assembly 300 with modular gear attachment belt 104 engaged to cummerbund 102 over tactical vest 401.

Figure 5:
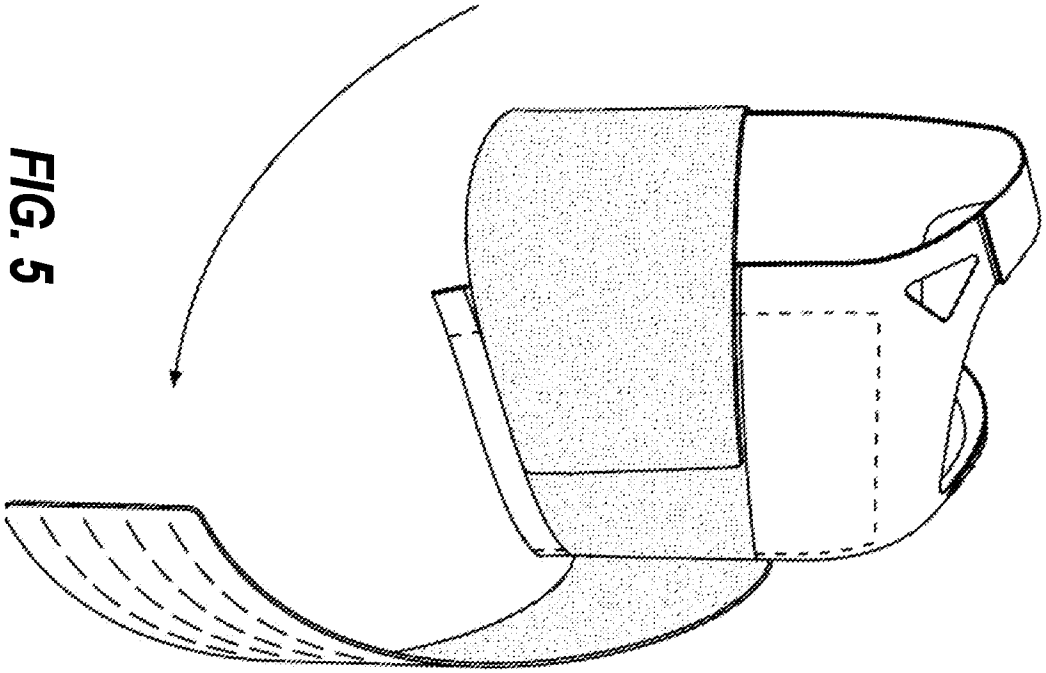
FIG. 5 depicts a 3D front right view of the example CWTGS assembly of FIG. 4H with one end of the modular gear attachment belt being pulled off that leaves the cummerbund undisturbed for replacing a second modular gear attachment belt, according to one or more embodiments.

FIG. 5 depicts a 3D front right view of example CWTGS assembly 300 with cummerbund 102 wrapped the same as in FIG. 4F with terminating right end portion 110*a* engaged second over terminating left end portion to secure example tactical vest 301. Terminating right end portion 110*a* of cummerbund 102 is thus the last portion engaged on top of terminating left end portion 110*b* and is directed toward the left lateral side. Pulling the right end of modular gear attachment belt 104 leaves the cummerbund 102 undisturbed for replacing a second modular gear attachment belt.

Figure 6:
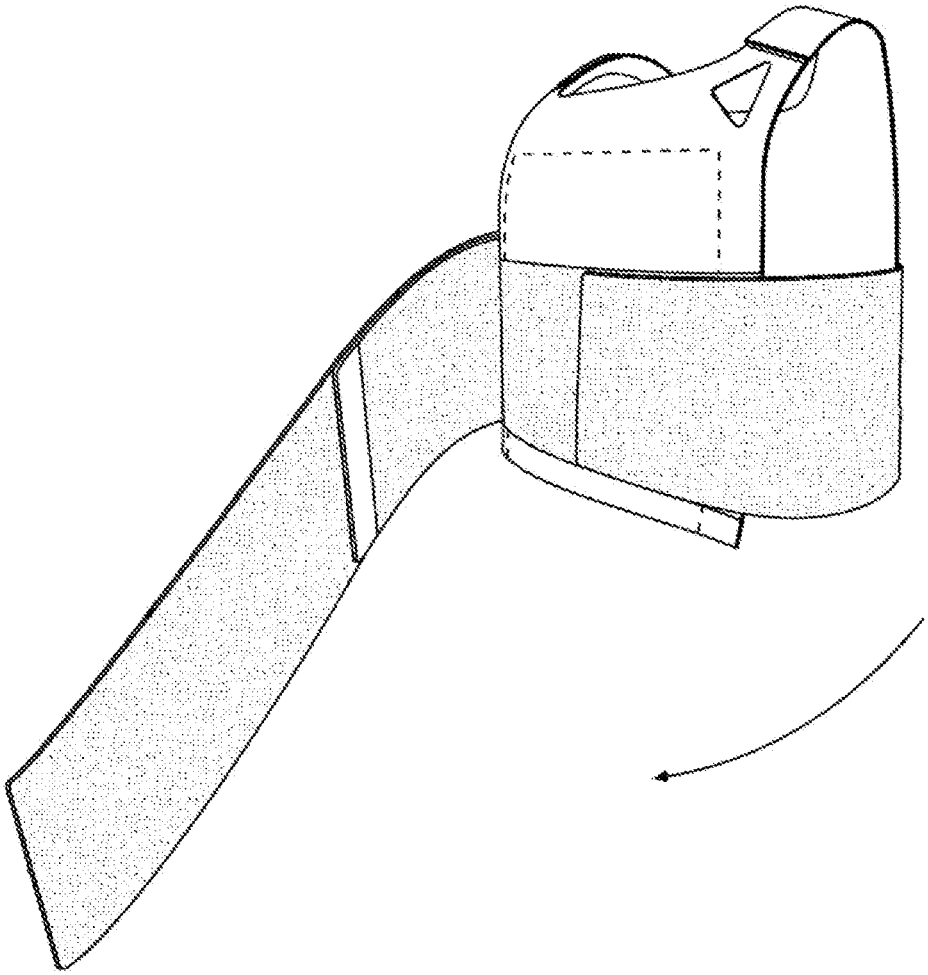
FIG. 6 depicts a 3D front right view of the example CWTGS assembly of FIG. 4H with another end of the modular gear attachment belt being pulled off that also pulls off the cummerbund from the tactical vest, according to one or more embodiments.

FIG. 6 depicts a 3D front right view of example CWTGS assembly 300 with cummerbund 102 wrapped the same as in FIG. 4F with terminating right end portion 110*a* engaged second over terminating left end portion to secure example tactical vest 301. Terminating right end portion 110*a* of cummerbund 102 is thus the last portion engaged on top of terminating left end portion 110*b* and is directed toward the left lateral side. Pulling the left end of modular gear attachment belt 104 pulls off terminating right end portion 110*a* of the cummerbund from example tactical vest 401, expediting removal of CWTGS assembly 300.

Figure 7A:
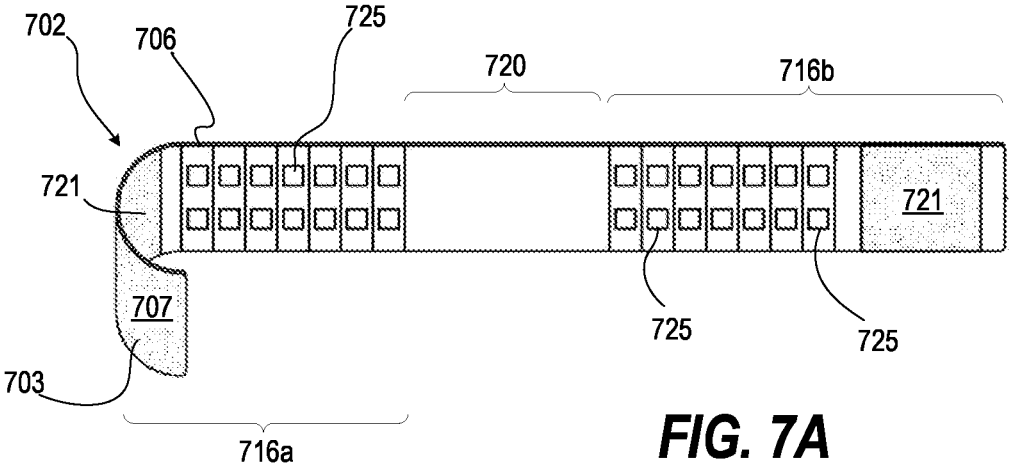
FIG. 7A depicts a three-dimensional (3D) view of an interior surface of the example cummerbund having constant width, according to one or more embodiments.
Figure 7B:
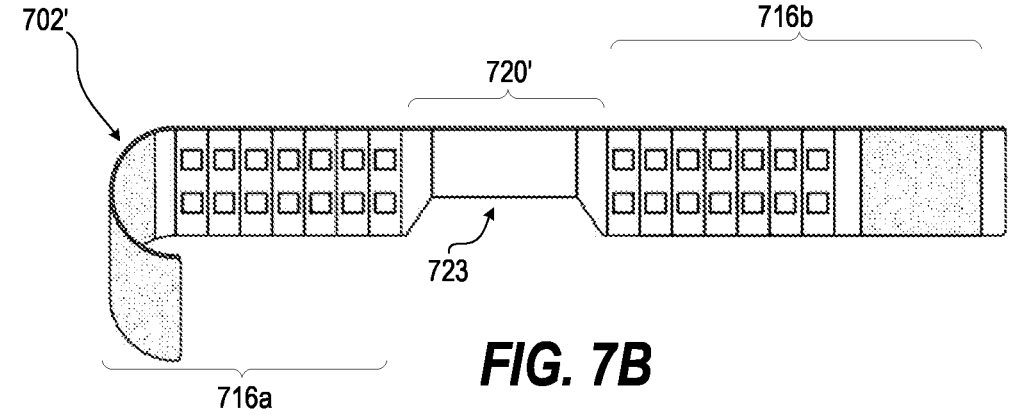
FIG. 7B depicts a 3D view of an interior surface of an example cummerbund having a reduced width rear portion, according to one or more embodiments.

FIG. 7A depicts a 3D view of example cummerbund 702 having constant width including central portion 720. External surface 703 of elongate band 706 includes outer engagement surfaces 707. Cummerbund 702 includes right and left inner surfaces that terminate respectively at first and second end portions 710*a*-710*b*. Right and left sections 716*a*-716*b* include respective complementary engagement pads 721 that releasably engage outer engagement surface 707 on external surface 703 of the other one of the right and left sections 716*a*-716*b*. Central portion 720 connects right and left sections 716*a*-716*b* of cummerbund 702. Right and left sections 716*a*-716*b* can include a modular equipment attachment interface such as modular grid voids 725, for attaching gear worn in contact with the body of the wearer (e.g. hip pads). FIG. 7B depicts a 3D view of an interior surface of example cummerbund 702' having reduced width central portion 720'. Cummerbunds 702, 702' of FIGS. 7A-7B respectively are otherwise the same.

In one or more embodiments, central portion 720 is formed of elastic material that adjusts to the girth of the wearer. Elastic material can be elastic fabric sections or materials such as nylon, polyester, or cotton. In some examples, the elastic materials may be woven, knitted, or braided. In one or more embodiments, cummerbund 702 is comprised of several layers of material, including an inner laminate and the outer layers. In one or more particular embodiments, the inner laminate includes a plurality of materials such as nylon, high abrasion resistant neoprene-coated KEVLAR, CORDURA, and similar materials that are used separately or in combination. For example, the materials could have a fiber thickness of 330 denier to 1000 denier (e.g., 500 denier) or have a combination of fibers with different thicknesses. Generally, denier is a unit of measurement that is used to determine the fiber thickness of individual threads or filaments used in the creation of textiles and fabrics. Fabrics with high denier count tend to be thick, sturdy, and durable while those with low denier count tend to be sheer, soft, and silky. The materials can be sewn, sealed, welded, bonded, riveted, or otherwise fixedly attached. Modular grid voids 725 can be formed by laser cutting, plasma cutting, hole or pattern punching, and other fabric cutting methods.

Cummerbund 702 can be dimensioned for one portion of a population of wearers. Elasticity and adjustment can be provided to reduce inventory requirements and to accommodate changes in a loadout configuration for the assigned wearer. In one or more embodiments, the tapered section of central portion 720' is a laminate having a width such as 1-2 inches (e.g., 1.5 inches). In one or more embodiments, central portion 720' has a width between 2.5-5 inches. In one or more embodiments, right and left sections 716*a*-716*b* have a worn vertical width of 4-7 inches, and have a length of 13-19 inches. Cummerbund 702' can be worn with tapered side 723 of central portion 720' either on top or on the bottom to position resulting chest rig 204 (FIG. 2A) either higher across the chest or lower along the hips or waist of the wearer. This allows the wearer to be able to carry the equipment longer, more comfortably, reduce fatigue, and other advantages.

Figure 7C:
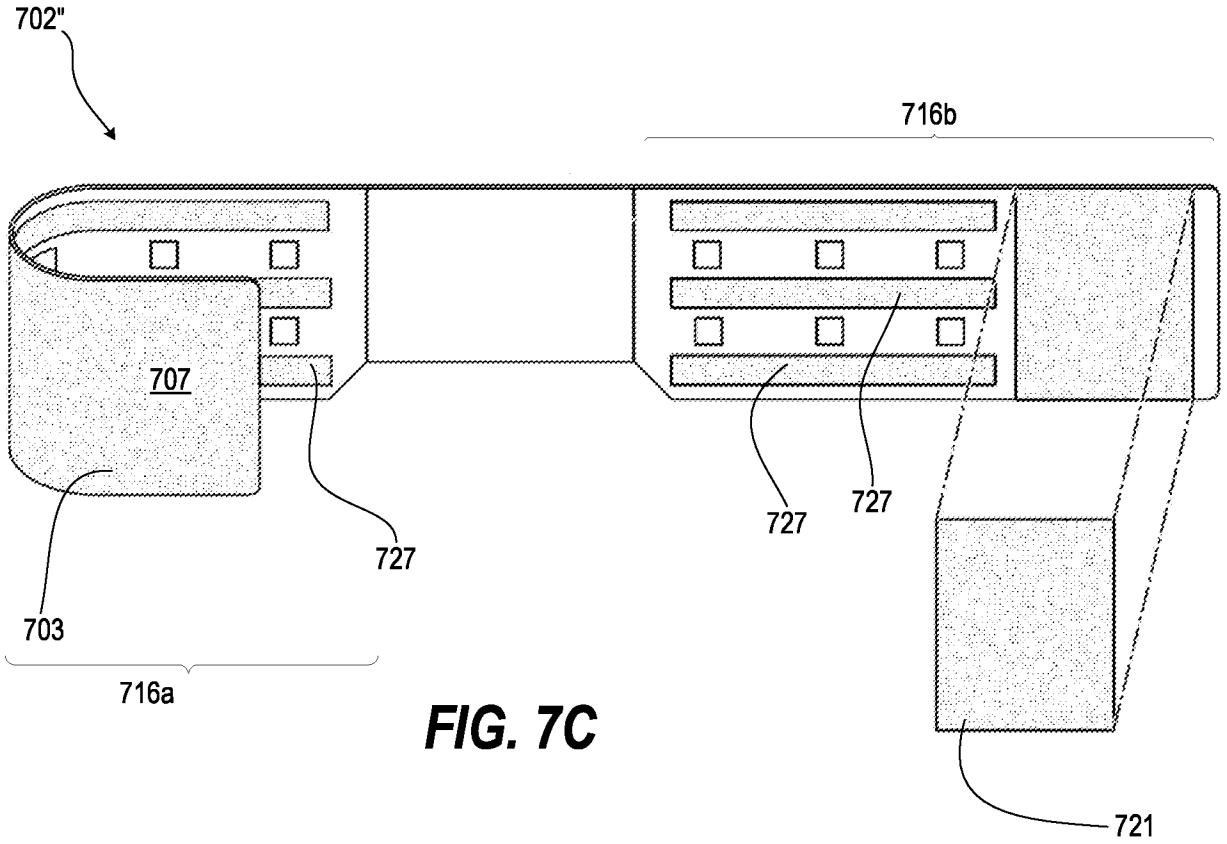
FIG. 7C depicts a 3D view of an interior surface of an example cummerbund having a reduced width rear portion and alternate attachment features, according to one or more embodiments.

FIG. 7C depicts a 3D view of example cummerbund 702" having horizontal engagement strips 727 on right and left inner surfaces 708*a*-708*b* inward to respective complementary engagement pads 721. One of right and left sections 716*a*-716*b* can be folded inwardly to engage corresponding complementary engagement pads 721 with adjacent horizontal engagement strips 727. The other one of complementary engagement pads 721 can engage the exterior surface 703 of the folded section 716*a*-716*b* to encircle a wearer with the cummerbund 702". The folded section 716*a*-716*b* reduces the length of the cummerbund 702". In some embodiments, a second complementary engagement pads 722 may releasably engage with complementary engagement pad 721 in order to provide additional padding for the wearer, or to reduce discomfort to the wearer, such as when complementary engagement pad 721 is composed of hook material.

As shown in the figures, modular gear attachment belts 804 (FIG. 8A), 804' (FIG. 8B), 804" (FIG. 8C), and 804'" (FIG. 8D), can incorporate tactical gear attachment features used in generally known chest rigs and tactical vests. In particular, tactical vests often include external systems or panels designed to allow the attachment of modular pouches, holsters, clips, and other equipment to be carried by the wearer. One example of such a system is the Modular Lightweight Load-carrying Equipment system (MOLLE) system. The MOLLE system is a proprietary form of military gear used by the U.S. Military and NATO forces since the early 2000's. The MOLLE system includes two components, a Pouch Attachment Ladder System (PALS) and MOLLE-compatible gear components designed to be attached thereto. PALS is a horizontal grid of repeating horizontal fabric 1-inch-wide webbing strips spaced 1 inch apart and sewn to the load-carrying surface at 1.5-inch intervals. Where a tactical vest includes a panel of PALS webbing, specific loadouts of articles or equipment (e.g. ammunition magazines or clips, weapons, radios, medical equipment, and hydration storage) can be configured by arranging and attaching MOLLE-compatible pouches and equipment to the PALS webbing for carrying the desired equipment. In particular, MOLLE-compatible pouches and equipment include fabric webbing strips designed to be woven and securely fastened to the panel of PALS webbing on the load-carrying gear. Other gear attachment systems or panels may also be used with the disclosed cummerbunds. In one alternative embodiment, for example, pouches, holsters, and/or other equipment carriers may be sewn or otherwise permanently attached to cummerbund 702, 702' or where a particular loadout configuration or arrangement is standardized, such as for a specific profession. In a second alternative embodiment, the widths and spacing between webbing that forms a grid of load-carrying surface may be varied to accommodate particular modular attachments. For instance, webbing and spacing may range from 0.5" up to 2" as long as the configuration of webbing is substantial enough to provide the sufficient tensile strength to reliably and securely secure the intended modular attachments and gear, while also being pliable enough to allow modular pouches or other gear to be woven into and attached to the grid.

Figure 8A:
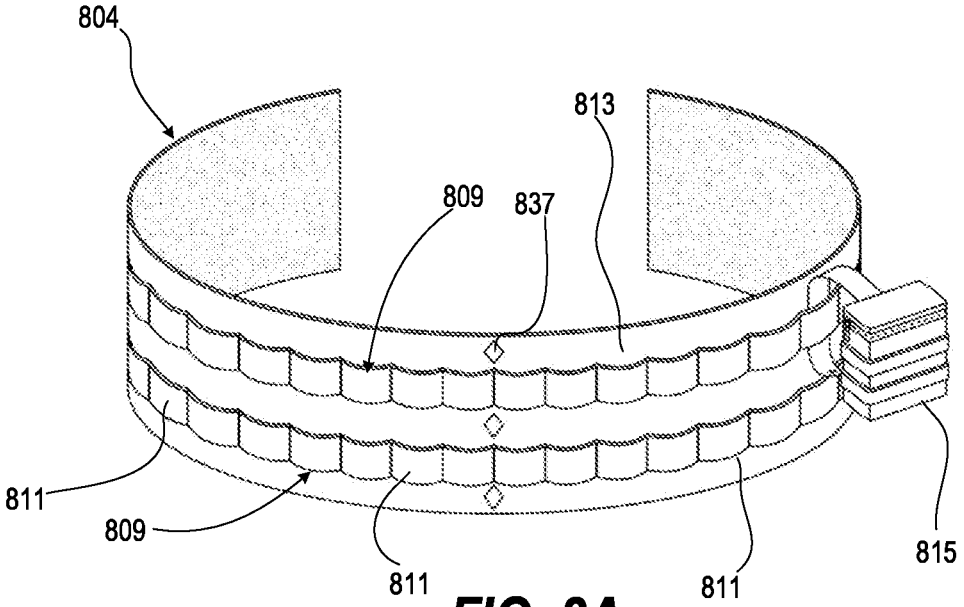
FIG. 8A depicts a 3D view of an example modular gear attachment belt with modular grid row strips with loops that are external to an outer surface, according to one or more embodiments.

FIGS. 8A-8D depict example modular gear attachment belts 804, 804', 804", and 804'" respectively that incorporate tactical gear attachment features for securely mounting MOLLE-compatible pouches and equipment. FIG. 8A depicts a 3D view of example modular gear attachment belt 804 with horizontally arranged flexible straps 809 with loops 811 that are external to an outer surface 813, which receive and secure compatible pouches and equipment 815. Alignment indicators 837 assist in centering modular gear attachment belt 804 to assist in aligning modular gear attachment belt 804 as it is attached to a donned cummerbund of the wearer. FIG. 8A depicts an example embodiment of a modular gear attachment belt 804 employing a Pouch Attachment Ladder System (PALS) having a plurality of horizontally arranged flexible straps 809, positioned at defined vertical intervals and being sewn to outer surface 813 at defined intervals to form grid row strips 809, to which compatible pouches and equipment 815 may be woven and securely fastened.

Figure 8B:
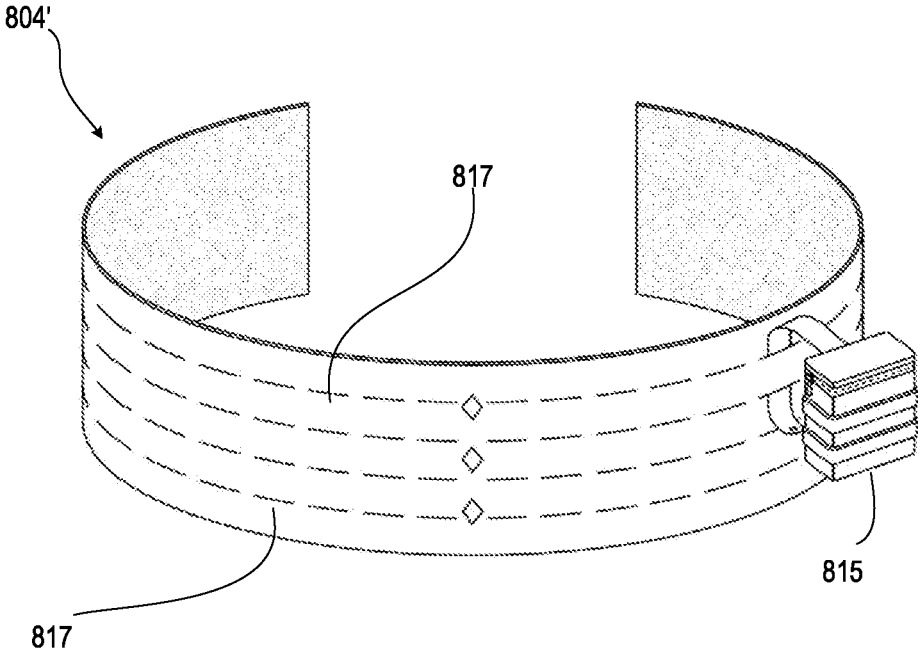
FIG. 8B depicts a 3D view of an example modular gear attachment belt with modular grid row slots, forming a grid pattern of attachment points, according to one or more embodiments.

FIG. 8B depicts a 3D view of a second example embodiment of a modular gear attachment belt 804' employing a Pouch Attachment Ladder System (PALS) having a plurality of horizontally disposed grid row slots 817 extending completely through outer surface 813, forming a grid pattern of attachment points to which compatible pouches and equipment 815 may be woven and securely fastened. Grid row slots 817 may be sized and disposed at defined vertical and horizontal intervals to form a grid pattern of attachment rows to which compatible pouches and equipment 815 may be woven and securely fastened. The example embodiment of modular gear attachment belt 804' depicted in FIG. 8B may be advantageous over standard PALS by eliminating the weight and bulkiness of a plurality of horizontally arranged flexible straps 809.

Figure 8C:
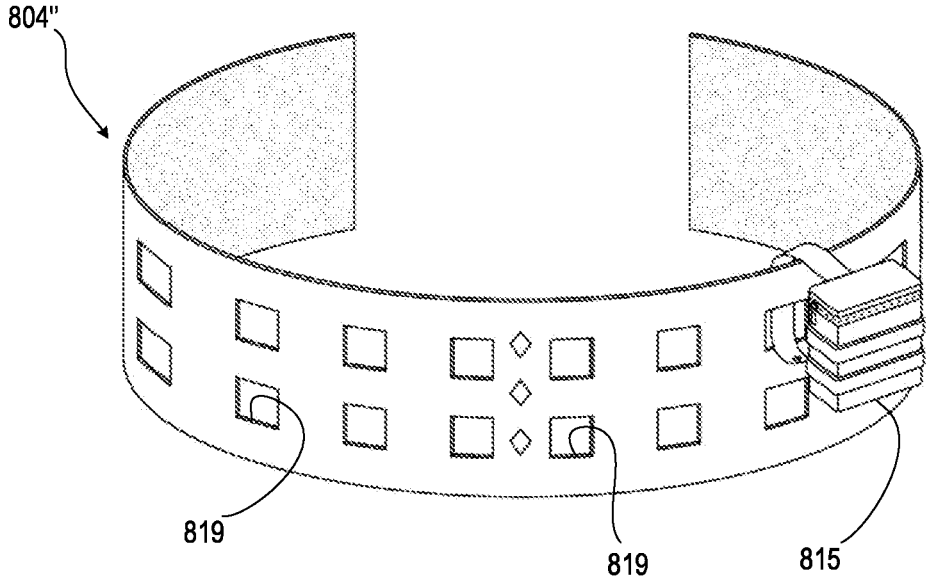
FIG. 8C depicts a 3D view of an example modular gear attachment belt with square cutouts, forming a grid pattern of attachment points, according to one or more embodiments.

FIG. 8C depicts a 3D view of a third example embodiment of a modular gear attachment belt 804" employing a Pouch Attachment Ladder System (PALS) having square grid cutouts (voids) 819 extending completely through outer surface 813, forming a grid pattern of attachment points for tactical gear 815. Square grid cutouts 819 may be sized and disposed at defined vertical and horizontal intervals to form a grid pattern of attachment rows to which compatible pouches and equipment 815 may be woven and securely fastened. The example embodiment of modular gear attachment belt 804" depicted in FIG. 8C may the advantageous over standard PALS by further eliminating the weight and bulkiness of a plurality of horizontally arranged flexible straps 809. Additionally, compatible pouches and equipment 815 may be woven and securely fastened either vertically, as illustrated in FIG. 8C, or horizontally.

Figure 8D:
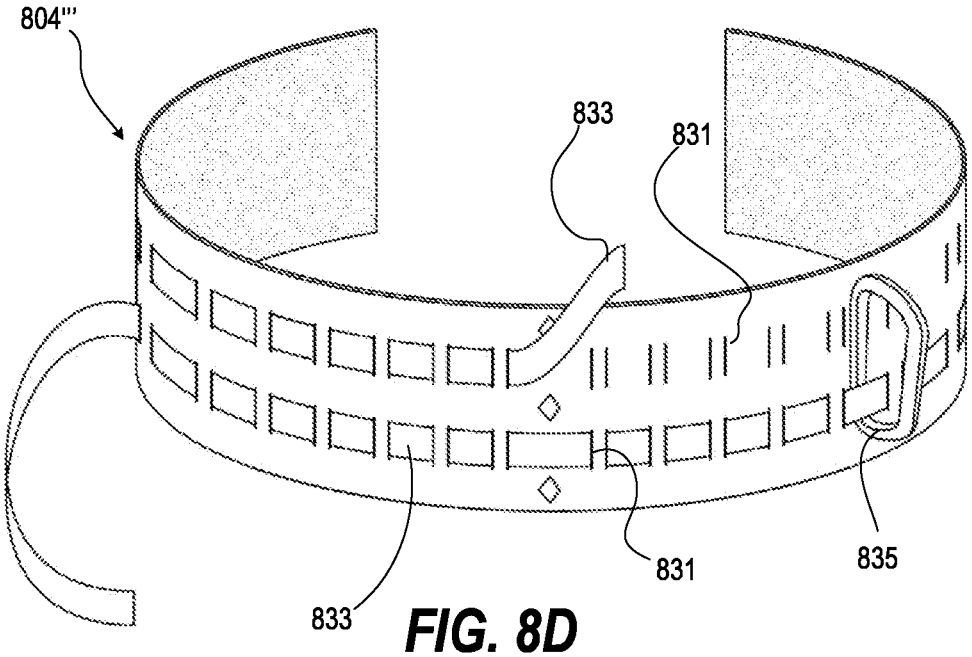
FIG. 8D depicts a 3D view of an example modular gear attachment belt with vertical grid slots and webbing, forming a grid pattern, according to one or more embodiments.

FIG. 8D depicts a 3D view of a fourth example embodiment of a modular gear attachment belt 804'" employing a Pouch Attachment Ladder System (PALS) having vertical grid slots 831 extending completely through outer surface 813 through which flexible straps 833 may be woven, forming a grid pattern to receive either compatible pouches and equipment 815 or other tactical gear 835. Flexible straps 833 may be fixed to either end of modular gear attachment belt 804'" by sewing or attachment to a clasp or other acceptable attachment. The example embodiment of modular gear attachment belt 804" depicted in FIG. 8D may the advantageous over standard PALS by allowing flexible straps 833 to be easily removed and replaced, thereby allowing a wearer to attach otherwise incompatible tactical gear to modular gear attachment belt 804'''. The same system of flexible straps 833 woven through grid slots 831 may similarly be implemented to attach separate components to one another. For example, a back panel of a chest-worn tactical gear support (CWTGS) having a flexible strap attached to a shoulder portion of the rear panel may be fixably attached to a front panel of a CWTGS having grid slots 831, thereby eliminating the need to sew the two panels together and allowing fast and easy exchange of a front panel or back panel of a CWTGS where desired.

Figure 9:
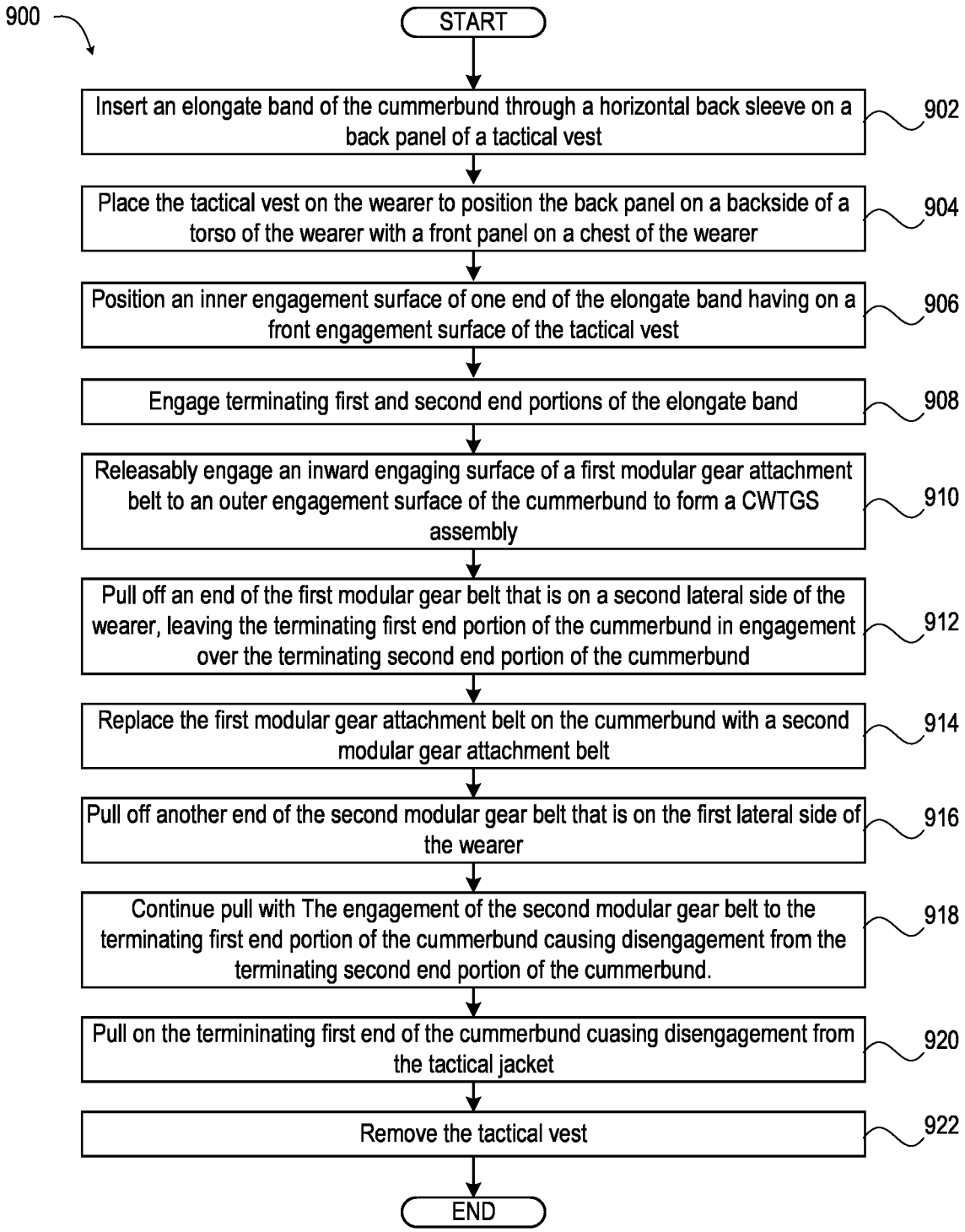
FIG. 9 presents a flow diagram of a method for expedited replenishment and reconfiguration of chest-worn gear and stores, according to one or more embodiments.

FIG. 9 presents a flow diagram of method 900 for expedited replenishment and reconfiguration of chest-worn gear and stores. In one or more embodiments, method 900 includes inserting an elongate band of a cummerbund through a horizontal back sleeve on a back panel of a tactical vest (block 902). Alternate embodiments do not include a tactical vest. Method 900 includes placing the tactical vest on the wearer to position the back panel on a backside of a torso of the wearer with a front panel on a chest of the wearer (block 904). The front and the back panels of the tactical vest are connected by right and left shoulder straps that rest on corresponding shoulders of the wearer. Method 900 includes positioning an inner engagement surface of one end of the elongate band having on a front engagement surface of the tactical vest (block 906). Method 900 includes engaging terminating first and second end portions of the elongate band (block 908). The terminating first end portion is over top of the terminating second end portion. The terminating first end portion is directed toward a first lateral side of the wearer. The terminating second end portion is directed toward an opposite second lateral side of the wearer. In one or more embodiments, the amount of overlap can adjust to fit a girth of the wearer. In one or more embodiments, a manual or elastic adjustment mechanism incorporated into the elongate band can provide adjustment for the girth of the wearer.

In one or more embodiments, the cummerbund is used solely to provide support to a lower portion of the tactical vest to form a CWTGS assembly. In one or more embodiments, the cummerbund is used to provide a chest rig for attachment of tactical gear and stores. With regard to the latter, method 900 includes releasably engaging an inward engaging surface of a first modular gear attachment belt to an outer engagement surface of the cummerbund to form a CWTGS assembly (block 910). In one or more embodiments, the first modular gear attachment belt is preconfigured with tactical gear and stores for a particular mission. Donning of the first modular gear attachment belt is expeditiously achieved by placing the first modular gear attachment belt onto the cummerbund.

In order to replenish or reconfigure the CWTGS assembly, method 900 includes pulling off an end of the first modular gear belt that is on a second lateral side of the wearer, leaving the terminating first end portion of the cummerbund in engagement over the terminating second end portion of the cummerbund (block 912). Method 900 includes replacing the first modular gear attachment belt on the cummerbund with a second modular gear attachment belt (block 914). The second modular gear attachment belt is provisioned with a second set of gear and stores for one or more of: (i) expedited replenishment of the first set of gear that is expended; and (ii) reconfiguration of the CWTGS assembly for different tactical mission requirements.

In order to expeditiously remove the CWTGS assembly, method 900 includes pulling off another end of the second modular gear belt that is on the first lateral side of the wearer (block 916). Method 900 includes continuing to pull the second modular gear belt with the engagement of the second modular gear belt to the terminating first end portion of the cummerbund causing disengagement from the terminating second end portion of the cummerbund (block 918). Method 900 includes disengaging the terminating first end of the cummerbund from the tactical jacket (block 920). Method 900 includes removing the tactical vest (block 922). Then method 900 ends.

It will be apparent to those skilled in the art that various modifications and variations can be made to the disclosed system. Other examples will be apparent to those skilled in the art from consideration of the specification and practice of the disclosed system. By way of non-limiting examples, magnets, buckles, buttons, or other attaching mechanisms could be used in the place of fastener surfaces. It is intended that the specification and examples be considered as illustrative, with a true scope being indicated by the following claims and their equivalents.

What is claimed is:

1. A chest-worn, tactical gear support (CWTGS) assembly, comprising:

a removable cummerbund comprising an elongate band wrappable around a torso of a wearer, the elongate band having an outer engagement surface and terminating at first and second end portions that adjustably engage to fit a girth of the wearer; and a removeable modular gear attachment belt comprising:

equipment receiving features on an outward surface, and an inward engagement surface that releasably engages the outer engagement surface of the cummerbund to form a chest rig;

wherein the cummerbund is releasably engaged to the modular gear attachment belt, such that force applied to the modular gear attachment belt in a first direction may disengage the modular gear attachment belt from the cummerbund, while force applied to the modular gear attachment belt in a second direction may disengage both the modular gear attachment belt and the cummerbund from the torso of the wearer.

2. The CWTGS assembly of claim 1, wherein the outer engagement surface of the cummerbund and the inward engagement surface of the modular gear attachment belt mutually engage using a selected one of: (i) hook and loop material fastening; (ii) magnetic attraction fastening; and (iii) male and female mechanical fastening.

3. The CWTGS assembly of claim 1, wherein the cummerbund comprises an elastic material that adjusts to the girth of the wearer.

4. The CWTGS assembly of claim 1, wherein the cummerbund comprises one or more belts that are adjustably buckled to longitudinally constrain a portion of the elongate band to fit the girth of the wearer.

5. The CWTGS assembly of claim 1, wherein the modular gear attachment belt is provisioned with a first set of gear, the CWTGS assembly comprising a second modular gear attachment belt to that is provisioned with a second set of gear, the second modular gear attachment belt replacing the first modular gear attachment belt on the cummerbund for one or more of: (i) expedited replenishment of the first set of gear that is expended; and (ii) reconfiguration of the CWTGS for different tactical mission requirements.

6. The CWTGS assembly of claim 1, further comprising a tactical vest comprising a front panel configured to couple to a back panel.

7. A chest-worn, tactical gear support (CWTGS) assembly, comprising:

a tactical vest comprising a front panel and a back panel connected by right and left shoulder straps, the front panel comprising a front engagement surface, the back panel comprising a horizontal back sleeve;

a removable cummerbund comprising an elongate band wrappable around a torso of a wearer of the tactical vest, the elongate band, having an inner engagement surface and an outer engagement surface, and terminating at first and second end portions that adjustably engage to fit a girth of the wearer, a rearward positioned portion of the cummerbund passing through the horizontal back sleeve of the tactical vest, the inner engagement surface releasably engaging the front engagement surface of the tactical vest and a removeable modular gear attachment belt comprising equipment receiving features on an outward surface, and an inward engagement surface that releasably engages the outer engagement surface of the cummerbund to form a chest rig;

wherein the cummerbund is releasably engaged to the tactical vest and to the modular gear attachment belt, such that force applied to the modular gear attachment belt in a first direction may disengage the modular gear attachment belt from the cummerbund, while force applied to the modular gear attachment belt in a second direction may disengage both the modular gear attachment belt and the cummerbund from the tactical vest.

8. The CWTGS assembly of claim 7, wherein the horizontal back sleeve comprises a top flap and a bottom flap that are releasably engaged by hook and loop material fastening.

9. The CWTGS assembly of claim 7, wherein the front engagement surface of the tactical vest and the inner engagement surface of the cummerbund mutually engage using a selected one of: (i) hook and loop material fastening; (ii) magnetic attraction fastening; and (iii) male and female mechanical fastening.

10. The CWTGS assembly of claim 7, wherein the first direction is in a lateral direction, and wherein the second direction is in a lateral direction opposite to the first direction.

11. The CWTGS assembly of claim 10, wherein the outer engagement surface of the cummerbund and the inward engagement surface of the modular gear attachment belt mutually engage using a selected one of: (i) hook and loop material fastening; (ii) magnetic attraction fastening; and (iii) male and female mechanical fastening.

12. The CWTGS assembly of claim 7, wherein the cummerbund comprises an elastic material that adjusts to the girth of the wearer.

13. The CWTGS assembly of claim 7, wherein the cummerbund comprises one or more belts that are adjustably buckled to longitudinally constrain a portion of the elongate band to fit the girth of the wearer.

14. The CWTGS assembly of claim 7, wherein the modular gear attachment belt is provisioned with a first set of gear, the CWTGS assembly comprising a second modular gear attachment belt to that is provisioned with a second set of gear, the second modular gear attachment belt replacing the first modular gear attachment belt on the cummerbund for one or more of: (i) expedited replenishment of the first set of gear that is expended; and (ii) reconfiguration of the CWTGS assembly for different tactical mission requirements.

15. A method for expedited replenishment and reconfiguration of chest-worn gear and stores, the method comprising:

wrapping an elongate band of a cummerbund around a torso of a wearer;

engaging terminating first and second end portions of the elongate band that adjustably engages to fit a girth of the wearer;

releasably engaging an inward engaging surface of a first modular gear attachment belt to an outer engagement surface of the cummerbund to form a chest-worn, tactical gear support (CWTGS) assembly, the first modular gear attachment belt having equipment receiving features on an outward surface that are provisioned with a first set of gear, wherein the cummerbund is releasably engaged to the modular gear attachment belt, such that force applied to the modular gear attachment belt in a first direction may disengage the modular gear attachment belt from the cummerbund, while force applied to the modular gear attachment belt in a second direction may disengage both the modular gear attachment belt and the cummerbund from the torso of the wearer;

replacing the first modular gear attachment belt on the cummerbund with a second modular gear attachment belt that is provisioned with a second set of gear and for one or more of: (i) expedited replenishment of the first set of gear that is expended; and (ii) reconfiguration of the CWTGS assembly for different tactical mission requirements.

16. The method of claim 15, wherein wrapping the elongate band of the cummerbund around the torso of the wearer comprises:

inserting the elongate band of the cummerbund through a horizontal back sleeve on a back panel of a tactical vest;

placing the tactical vest on the wearer to position the back panel on a backside of the torso of the wearer with a front panel on a chest of the wearer, the front and the back panels connected by right and left shoulder straps that rest on corresponding shoulders of the wearer; and positioning an inner engagement surface of the elongate band having to engage a front engagement surface of the tactical vest.

17. The method of claim 15, wherein:

engaging terminating first and second end portions of the elongate band of the cummerbund comprises placing the terminating first end portion over the terminating second end portion, the terminating first end portion directed toward a first lateral side of the wearer; and subsequently replacing the first modular gear attachment belt comprises pulling off an end of the first modular gear belt that is on a second lateral side of the wearer, leaving the terminating first end portion in engagement over the terminating second end portion of the cummerbund.

18. The method of claim 17, further comprising expeditiously removing the CWTGS assembly by pulling off another end of the second modular gear belt that is on the first lateral side of the wearer, the engagement of the second modular gear belt to the terminating first end portion of the cummerbund causing disengagement from the terminating second end portion of the cummerbund.

19. The method of claim 15, wherein the first direction is in a lateral direction, and wherein the second direction is in a lateral direction opposite to the first direction.

* * * * *